United States Patent [19]

Bailey

[11] 3,990,238

[45] Nov. 9, 1976

[54] STEAM ENGINE

[76] Inventor: Joseph H. Bailey, 1740 Rowley Ave., Cleveland, Ohio 44109

[22] Filed: Sept. 26, 1975

[21] Appl. No.: 617,095

[52] U.S. Cl. ..... 60/513

[51] Int. Cl.[2] ..... F01B 29/08; F01B 31/08

[58] Field of Search ..... 60/508–515, 60/670, 671

[56] References Cited

UNITED STATES PATENTS

| | | | |
|---|---|---|---|
| 861,047 | 7/1907 | Oddie | 60/715 |
| 977,731 | 12/1910 | Haennig | 60/514 X |
| 1,933,041 | 10/1931 | Bauer | 60/715 |
| 2,839,888 | 6/1958 | Mallory | 60/515 X |
| 3,905,195 | 9/1975 | Gregory | 60/512 |

FOREIGN PATENTS OR APPLICATIONS

| | | | |
|---|---|---|---|
| 425,074 | 9/1947 | Italy | 60/513 |
| 235,061 | 6/1925 | United Kingdom | 60/513 |

*Primary Examiner*—Allen M. Ostrager
*Attorney, Agent, or Firm*—Ronald R. Stanley

[57] ABSTRACT

An engine is disclosed which includes most of the parts of a conventional internal combustion engine with the exception of the fuel and intake mechanisms. In place of the fuel and intake portions, a steam head is substituted. A fluid to be utilized as steam is injected at varying small quantities into the head where the fluid is heated to produce steam. A valve train lets steam into the cylinder forcing the piston down. On the return stroke the piston forces the exhaust steam out an open exhaust valve. The movement of the piston, results in rotation of a crank. Either the rotation of the crank or the exhaust steam, or both, are utilized to produce electrical energy which is used to produce the steam and thus at least partially minimize the amount of fuel required to operate once the engine is operated for a short time.

5 Claims, 2 Drawing Figures

STEAM ENGINE

BACKGROUND OF THE INVENTION

1. Field of the Invention

This invention relates generally to an engine and, more particularly, to an engine utilizing steam to considerably reduce the exhaust pollutants and the use of the fuels.

The internal combustion engine has received much criticism of late with respect to being inefficient in that it wastes fuel and causes pollution. Between ecology and energy conservation, the internal combustion engine would be extinct if any other realistic motivation means had yet been discovered.

With the recent energy crisis, efforts have been tried to making engines more efficient as to the use of petroleum. Often the gains made towards ecology are sacrificed.

2. Prior Art

In an effort to achieve one or both of the goals stated above, numerous relatively new or formerly unused motivation sources have surfaced in the present technology. To this end, the rotary engine has met with at least a moderate amount of acceptance and success. But rotary engines still use petroleum fuels (not that much more efficiently) and produce pollutant wastes although possibly to a lesser extent.

Electric power has been investigated as a replacement for internal combustion engines, but problems have been encountered. First, the electrical power must be produced somehow. If petroleum or other natural resources are to be utilized to produce the electric power, at least one phase of the problem is not solved. But electrical power has more serious problems with regard to its efficiency in developing torque and output power. Particularly in the field of automobiles, electric power does not yet respond with the quickness desired, in fact almost necessary, for motor vehicles in our present fast paced society.

Even the steam engine, an apparently extinct species from days gone by, has been revived in various forms to meet the demand for lower fuel consumption and less pollution. A number of automotive manufacturers have experimented with steam engine designs, but apparently none have yet been successful. The steam engine concept has to some extent been combined with various other engines and concepts. The present invention is one example of a unique combination of steam and internal combustion concepts.

SUMMARY OF THE INVENTION

It is a general object of this invention to provide a new and improved engine for generating a useful power output while conserving energy and limiting pollutant outputs.

Further objects of this invention are to provide a new and improved engine for generating a useful power output which utilizes concepts of steam pressure, which utilizes concepts of internal combustion and which utilizes a portion of the power output to at least partially minimize fuel input requirements.

Still further objects of this invention are to provide a new and improved engine for generating a useful power output which combines steam pressure and internal combustion features to result in a more efficient engine, which conserves the use of petroleum and other fuels, and which considerably minimizes any harmful output pollutants as a result of exhaust from the engine.

Still another object of this invention is to provide an engine for generating a useful power output obtaining one or more of the objects and advantages hereinbefore set forth.

These and other objects and advantages of this invention will appear from the following description of preferred forms thereof, reference being made to the accompanying drawings.

DESCRIPTION OF THE PREFERRED EMBODIMENT

The engine of this invention combines features of both steam engines and internal combustion engines to result in an engine providing greater power output and response than either steam or internal combustion while assisting conservation of energy and minimization of pollution.

Figure 1:
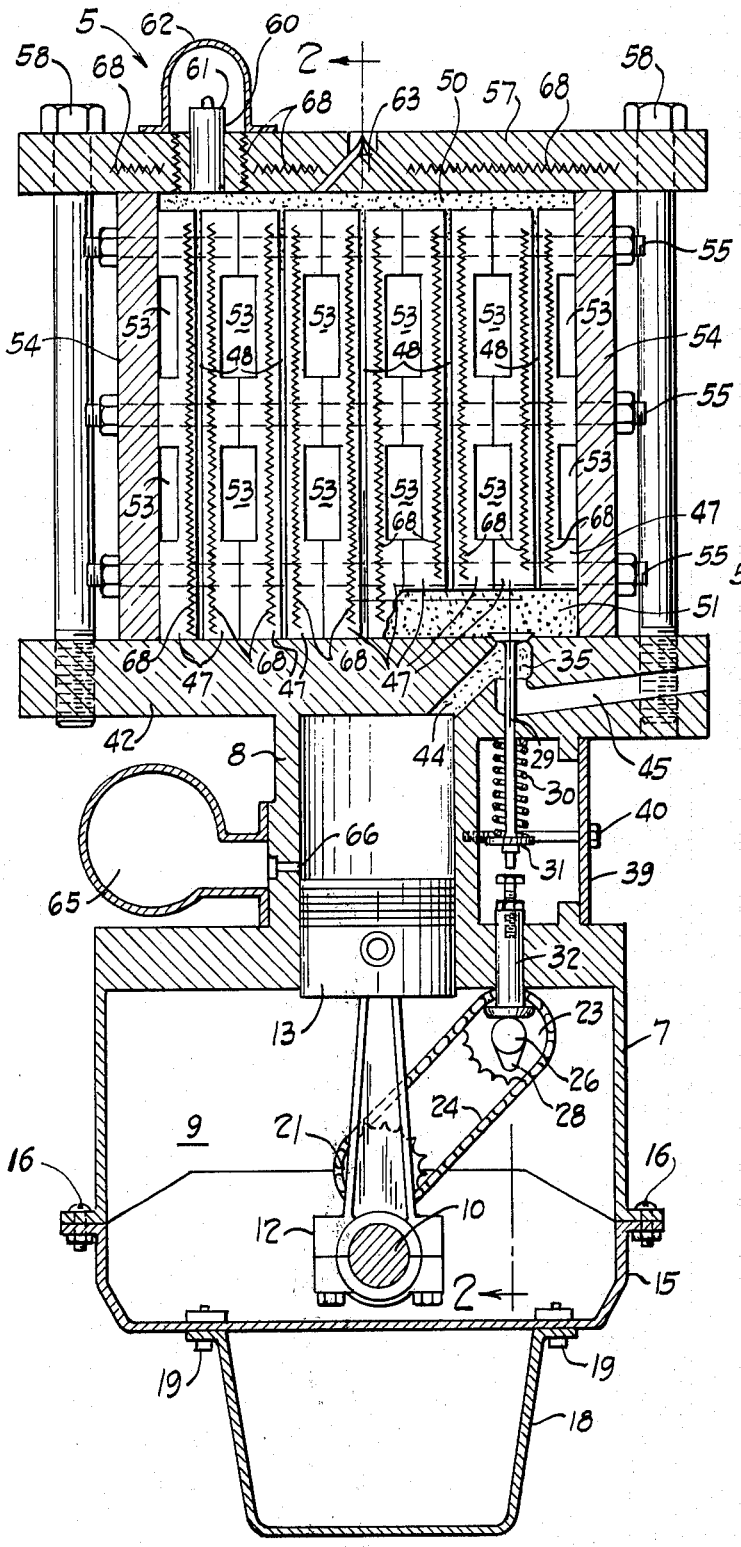
FIG. 1 is a partial cross-sectional view of the engine of this invention.

The engine of this invention, indicated generally as 5, is shown in FIG. 1 in a partial cross-sectional view. The lower portion of the engine 5 comprises a mostly conventional internal combustion engine components. In this respect, a block 7 is provided which includes at least one cylinder 8 and a structural web 9 used for supporting components of the engine 5.

One of the components supported by the structural web 9 is a crank 10 which has a throw or journal for each cylinder, such as cylinder 8, and appropriately machined areas for mounting to the structural web. The details of the crank are not explicitly dealt with in this disclosure for the reason that they are not necessarily unique, but rather conventional with respect to engines. To each throw or journal of the crank 10 is attached a connecting rod 12 by means of bolts or other suitable fasteners. A suitable bearing may be provided between the crank 10 and connecting rod 12 as desired.

A piston 13 is attached to an end of the connecting rod 12 and positioned concentrically within a cylinder 8 of the engine 5. The piston 13 is preferably provided with oil sealing and compression rings as well known in the art.

An oil pan 15 having one surface open is removably attached to the block 7 by means of bolts 16 or any other suitable fastener means. The purposes of the oil pan 15 is to catch all the oil which is recirculated throughout the engine 5 for lubrication purposes. In this particular engine design, a secondary oil pan 18 is removably attached to the bottom of the oil pan 15. The secondary oil pan 18 is attached by means of bolts 19 or any other suitable means.

While the oil caught by the oil pan 15 may have, and most probably will have, not only dirt, grit and particles, but also water or steam therein, it is desirable that this oil not be recirculated through the engine. For this reason, the oil caught by the oil pan 15 is first drawn off by a scavenger pump (not shown in the figures) and routed first to a separator where the water is separated from the oil and second the oil is routed to a filter to eliminate dirt, grit and other particles. The separated and filtered oil is then transferred to the secondary oil pan 18. A second pump (not shown in the figures) then recirculates the separated and filtered oil throughout the engine 5.

A drive gear 21, provided as part of or affixed to the crank 10, is caused to be rotatably driven as a result of the rotation of the crank. The drive gear 21 is connected to a second drive gear 23 by means of a chain or toothed belt drive 24. The crank and cam may also be connected by means of direct gearing. This second drive gear 23 is secured to a cam shaft 26 which is rotatably supported by the block 7 so that when the second drive gear 23 rotates, the cam shaft 26 also rotates.

The cam shaft 26 is of conventional design having two lobes for each cylinder 8. The details of the cam shaft 26 and its associated hardware are more readily understood with the aid of FIG. 2. A first lobe 28 operates an intake valve 29 at the appropriate times. The remainder of the valve train for the first lobe 28 includes a spring 30, spring retainer 31 and adjustable lifter 32. A second lobe 34 likewise operates an exhaust valve 35 at the appropriate times. Again, the second lobe 34 has a valve train including a spring 36, spring retainer 37 and adjustable lifter 38. A plate 39 covers the adjustable lifters 32 and 38 to allow for adjustment of the valves 29 and 35 and is held in place by a bolt 40 or other suitable means.

Figure 2:
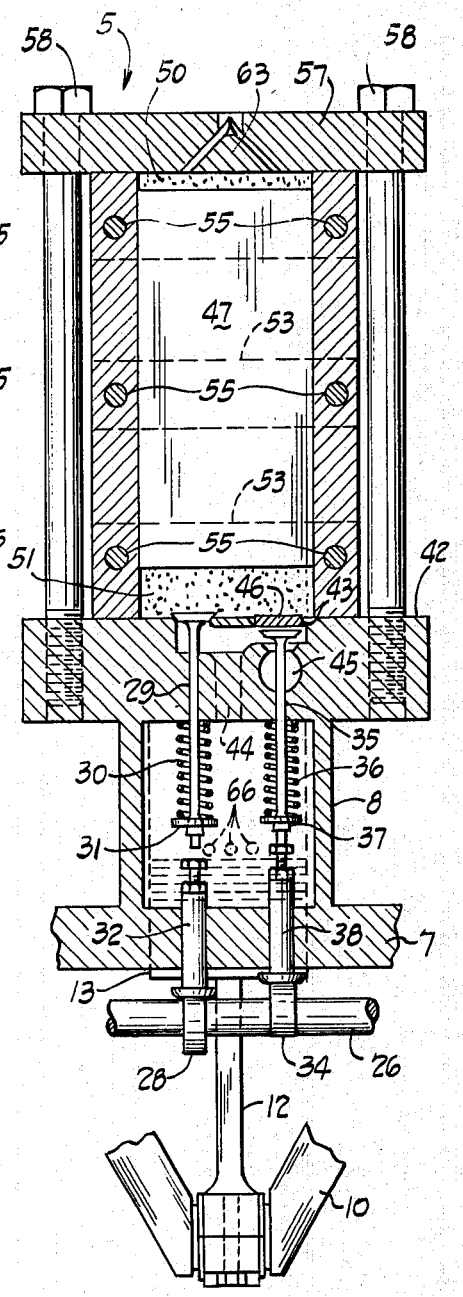
FIG. 2 is a sectional view of the engine of FIG. 1, taken substantially along line 2—2 of FIG. 1.

So far the discussion has concerned the internal combustion components of the engine 5. Moving now to the steam pressure components of the engine, the upper portions of FIGS. 1 and 2 are of particular importance.

A head plate 42 is attached to the top of the cylinder 8 in any suitable manner such as casting or bolting. The head plate 42 includes seats for the valves 29 and 35. The valves 29 and 35 allow the movement of steam in this case into the cylinder 8 through the passage 44 and out of the engine through a passage 45. The passage 45 acts as an exhaust manifold for steam leaving the engine. The intake valve 29 opens the passage 44 to the area directly above the head plate 42 for a purpose to be explained shortly and therefore has its seat directly on the top face of the head plate 42. The exhaust valve 35 has its seat within the head plate 42 and connects to the passage 45. However, for the purpose of assembling the engine 5 and, more particularly, the valve 35, a passage 43 is provided in the top surface of the head plate 42 through which the valve 35 is inserted into position. Since the exhaust valve 35 is not desired to be opened into the port of the head-plate 42, a plug 46 is provided and securely inserted into the passage 43 once the valve has been positioned.

A number of heat plates 47 (in this case 10) are assembled adjacent to one another on the top surface of the head plate 42. The heat plates 47 are exactly identical as far as construction and are preferably assembled with gaskets therebetween. The steam plates are desired to be constructed so that they are reversible with respect to side to side aiding manufacturing and assembly.

Extending vertically between adjacent heat plates 47 is a steam passage 48. The top and bottom edge of each heat plate 47 is concave or machined out in a manner forming a cavity at the top 50 and bottom 51 of the assembled heat plates 47 so that all of the steam passages 48 are connected. Each heat plate 47 also has two cavities 53 formed in or machined out of one side of the plate. These cavities 53 are located so that when the heat plates 47 are positioned adjacent to one another the cavities 53 coincide and form a fairly large passage.

At either end of the adjacent heat plates 47 is an side plate 54. All of the heat plates 47 and the two side plates 54 are through bolted by means of bolts 55 or any other suitable means. For purposes of through bolting the heat plates 47 and side plates 54, holes are provided through all the plates at the appropriate positions.

A top plate 57 is positioned on top of the heat plates 47 and side plates 54 and makes a sealing engagement therewith. The top plate 57 is firmly secured to the head plate 42 by means of bolts 58. The assembly of the heat plates 47 and side plates 54 is thus securely clamped between the top plate 57 and head plate 42.

The top plate is further provided with a fitting 60 for a safety steam valve 61 which releases pressure if the steam in the engine 5 reaches a predetermined level. The safety valve 61 should be connected to the cooling system as through a manifold 62 so that no steam escapes as exhaust into the atmosphere. Also, an injector valve 63 is located in the top plate 57 and serves a purpose to be described shortly.

One addition is made to the internal combustion portion of the engine 5 as a result of the use of steam. This addition is a steam chest 65 which is attached to the side of the cylinder 8 by means of any suitable fastening devices such as bolts. The steam chest 65 sealingly engages the cylinder 8 by means of a gasket or other such means so that there is no loss of steam between the two.

The cylinder 8 of the engine 5 has one or more apertures 66 at the lower end of the travel of the piston 13. The apertures 66 are positioned so that when the piston 13 is anywhere except at the bottom of its stroke, the apertures 16 are covered or inaccessible. The steam chest 65 has an opening corresponding to the aperture 66 such that a fluid flow can readily pass from the cylinder 8 into the steam chest 65. A check valve (not shown in the figures) assures that the fluid flow is only into the steam chest and not back into the cylinder 8.

Throughout the steam portion of the engine 5, electrical resistance heating coils 68 are located immediately adjacent to the steam passages 48 and the top cavity 50. The purpose of the electrical resistance heating coils will be explained subsequently.

The operation of the engine 5 utilizing the steam pressure and internal combustion components can now be explained. A burner (not shown in the figures) using any type of fuel desired, i.e., gas, oil, wood, etc., is positioned so that the flame therefrom when ignited extends through the cavities 53 within the steam portion of the engine 5. Appropriate mounting, fuel input and exhaust ducting for the burner are provided. To operate the engine 5, the burner is ignited and the flames therefrom extend through the cavities 53 causing oil of the metal parts of the steam portion of the engine to be heated.

Once the engine has been heated to a sufficient extent, a small quantity of liquid, e.g., water, etc., is inserted into the top cavity 50 by means of operation of the injector valve 63. Due to the heat of the metal parts in the engine, particularly the heat plates 47, the liquid is instantly converted to steam.

When sufficient heat has been built up, the crank 10 of the engine 5 is turned in a manner similar to any conventional engine, i.e., battery operated starter motor. As the piston 13 reaches the top of its stroke, the chain 24 and drive gears 21 and 23 cause the cam 26 to rotate to a position where the first lobe 28 exerts force upward to the adjustable lifter 32 resulting in the intake valve 29 opening.

Immediately upon the opening of the intake valve 29, steam pressure from the bottom cavity 51 rushes into the cylinder 8 through the passage 44. The steam pressure forces the piston 13 downward causing the crank 10 to be turned. When the top of the piston reaches the apertures 66 in the cylinder 8, part of the steam pressure enters the steam chest 65 and is restrained therein by reason of the check valve above mentioned.

The piston 13 continues its movement in the cylinder 8 due to the continued rotation of the crank 10 now caused by the thrust from the steam. At or after the bottom of the stroke of the piston 13, the cam 26 has been rotated by the chain 24 and gears 21 and 23 to an extent resulting in the second lobe 34 being positioned in functional contact with the adjustable lifter 38. As the lifter 38 rises on the lobe 34 the exhaust valve 35 is opened. Meanwhile, the piston 13 is moving upward in the cylinder 8 caused by the continued rotation of the crank 10. As the piston 13 moves upward, the remaining steam pressure in the cylinder 8 is forced out of the cylinder through the open exhaust valve 35 and the passage 45. The exhaust steam, without harmful pollutants, is ducted away from the engine to either be utilized in another manner or condensed through the use of a cooling system.

When the piston 13 has reached the top of its stroke, the second lobe 34 of the cam 26 will have passed thus closing the exhaust valve 35. Almost simultaneously the first lobe 28 of the cam will again cause the intake valve 29 to open, thus allowing steam pressure to enter the cylinder again and force the piston 13 down. From this point on the cycle will continue to repeat itself in accordance with the above discussion.

Each cycle of the engine 5 results in more steam pressure accummulating in the steam chest 65. The pressure in the steam chest 65 may be utilized to do work as for instance, operate an electrical power generator. The exhaust steam exiting through the passage 45 may also be utilized to do work as in generating electrical power. Further, as in the case of most engines, a generator for electrical power may be provided for and be driven mechanically by the movement of the crank 10 of the engine 5.

With the engine 5 producing some amount of electrical power through one or more of the above mentioned means, the electrical resistance heating coils 68, embedded within the heat plates 47 and top plate 57 as noted above, may be utilized to heat the steam portion of the engine in order to cause steam to be produced. In this manner, the amount of fuel necessary to sustain operation of the engine may be minimized with respect to incremental units of additional energy.

While it may be readily expected that an engine such as that described herein, would tend to operate rather roughly if only one cylinder were utilized, multiplication of the principles to more than one cylinder is considered an obvious step. In this regard, a three cylinder engine is considered to be a rational design choice. Such an engine would result in a thrust at equal thirds of a total rotation of the crank and thus cause smooth operation. Further, in view of the power expected from steam pressure, i.e., 545° F resulting in approximately 1000 pounds of pressure, three cylinders would deliver sufficient power in order to perform the functions presently performed by most internal combustion engines.

Another possibility is to eliminate the burner and fuel from the operation of the engine 5. This could be done by connecting the electrical resistance heating coils 68 directly to an external electric power source. The heating of the heat plates 47 and top plate would occur as before and initiate operation of the engine 5. Once the engine were generating enough electrical power on its own, the external power could be reduced or minimized.

The engine as described herein can be produced in a variety of sizes to suit the particular need. The uses of the engine are endless and include motivation for motor vehicles (road, water and air), electrical power generation, fluid pumping (water, oil, gas, etc.), heating etc.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth therein, but rather should be limited by the advance by which the invention has promoted the art.

I claim:

1. An improvement in an engine for providing a useful power output, the engine having a crank shaft, at least one piston, corresponding cylinders, cam shaft and intake and exhaust valve trains, the improvement comprising steam pressure head means integrally connected to the cylinder, said steam pressure head means having a plurality of narrow passages, electrical resistance heating elements positioned adjacent to each of said plurality of narrow passages, electrical source means energizing said electrical resistance heating elements to raise the temperature of the steam pressure head means, injector means selectibly inserting a small quantity of fluid into said steam pressure head means at one end of the plurality of narrow passages, the energized electrical resistance heating elements instantly vaporizing the fluid as said fluid passes through the plurality of narrow passages, an intake valve of said intake and exhaust valve train operated by the cam shaft in conjunction with the crank shaft opening when the piston is near the top of the cyclinder resulting in vaporized fluid from the said steam pressure head means entering the cylinder and forcing the piston downward to cause the crank shaft to rotate, an exhaust valve of said intake and exhaust train opening when the piston is returning to the top of the cylinder resulting in the remaining vaporized fluid in said cylinder being forced out of the cylinder, and generating means using at least a portion of the vaporized fluid in said cylinder to generate power independent of rotation of the crank shaft.

2. An engine according to claim 1 in which the steam pressure head means is additionally heated by a burner utilizing an externally provided natural resource such as oil, gas, wood and coal as a fuel.

3. An engine according to claim 1 in which said electrical resistance heating elements are operated by power generated by said generating means whereby the steam pressure head means is heated by the output of the engine enabling usage of external energy sources operating the heating means to be reduced or minimized.

4. An engine according to claim 1 in which said generating means comprises a pressure cylinder integrally connected with said cylinder of the engine and an electrical generator whereby a quantity of vaporized fluid is drawn off from the cylinder at each downward stroke of the piston and this steam utilized to operate the electrical generator.

5. An engine according to claim 1 in which three cylinders, pistons and steam pressure head means are utilized.

* * * * *